US008564263B2

(12) United States Patent
Chen

(10) Patent No.: US 8,564,263 B2
(45) Date of Patent: Oct. 22, 2013

(54) VOLTAGE REGULATOR

(75) Inventor: Chi-Yang Chen, Tainan (TW)

(73) Assignee: Faraday Technology Corp., Hsin-Chu (TW)

( * ) Notice: Subject to any disclaimer, the term of this patent is extended or adjusted under 35 U.S.C. 154(b) by 256 days.

(21) Appl. No.: 13/241,476

(22) Filed: Sep. 23, 2011

(65) Prior Publication Data

US 2012/0169303 A1 Jul. 5, 2012

(30) Foreign Application Priority Data

Jan. 4, 2011 (TW) ..... 100100237 A

(51) Int. Cl.
*G05F 1/573* (2006.01)

(52) U.S. Cl.
USPC ..... 323/277; 323/226

(58) Field of Classification Search
USPC ..... 323/226, 273–281
See application file for complete search history.

(56) References Cited

U.S. PATENT DOCUMENTS

| | | | | |
|---|---|---|---|---|
| 7,183,755 | B2 | 2/2007 | Itoh et al. | |
| 7,233,462 | B2 | 6/2007 | Kanakubo | |
| 2009/0206807 | A1 * | 8/2009 | Imura et al. | 323/277 |
| 2010/0213909 | A1 * | 8/2010 | Nakashimo | 323/282 |

* cited by examiner

*Primary Examiner* — Harry Behm
*Assistant Examiner* — Matthew Grubb
(74) *Attorney, Agent, or Firm* — Winston Hsu; Scott Margo

(57) ABSTRACT

A voltage regulator includes a constant voltage power circuit and an overcurrent protection circuit. The constant voltage power circuit generates an output voltage, an output current and a divided voltage. The overcurrent protection circuit includes a current sensing unit, a first mirroring unit, a voltage to current converting unit, a second mirroring unit, and a pull up unit. The current sensing unit generates a sensing current according to the output current. The first mirroring unit generates a first mirroring current. The first mirroring current is proportional to the output current. The voltage to current converting unit is used for converting the divided voltage into a first current. The second mirroring unit generates a second mirroring current. The second mirroring current is proportional to the second current. The pull up unit controls the output voltage and the output current according to the first mirroring current and the second mirroring current.

13 Claims, 9 Drawing Sheets

VOLTAGE REGULATOR

This application claims the benefit of Taiwan Application No. 100100237, filed Jan. 4, 2011, the subject matter of which is incorporated herein by reference.

FIELD OF THE INVENTION

The present invention relates to a voltage regulator, and more particularly to a voltage regulator with a fold-back overcurrent protection circuit.

BACKGROUND OF THE INVENTION

A voltage regulator having an overcurrent protection circuit limits an output current to prevent the voltage regulator from being burned when the output current exceeds an overcurrent value. In addition to the function of limiting the output current to be below the overcurrent value, the voltage regulator with a fold-back overcurrent protection circuit reduces the output current when an output voltage is lowered. Therefore, it prevents the voltage regulator from being burned and reduces power consumption.

Please refer to FIG. 1A and FIG. 1B. FIG. 1A is a circuit diagram of a voltage regulator with a drooping type overcurrent protection circuit. FIG. 1B is a graphical representation explaining the output voltage and the output current of the voltage regulator with the drooping type overcurrent protection circuit. As shown in FIGS. 1A and 1B, a constant voltage power circuit comprises a reference voltage 10, an output transistor 12, an error amplifier 11, a resistor 13, and a resistor 14.

The resistor 13 and the resistor 14 are connected in series between an output voltage (Vout) and a ground voltage to form a voltage divider circuit. Therefore, a voltage Va at a node A is proportional to the output voltage (Vout). The voltage Va at the node A is a feedback signal to be inputted into the error amplifier 11. The error amplifier 11 amplifies the difference voltage between the reference voltage 10 and the voltage Va. An output terminal of the error amplifier 11 generates an amplified difference voltage and controls the output transistor 12. Therefore, the output voltage (Vout) has a constant value. The detailed operation method will be illustrated as follows.

In normal operation, the voltage Va at the node A is close to the reference voltage 10. When the voltage Va at the node A is lower than the reference voltage 10, the amplified difference voltage decreases. Consequently, a gate-source voltage of the output transistor 12 increases and the on resistance decreases. Therefore, the output voltage (Vout) increases. Conversely, when the voltage Va at the node A is higher than the reference voltage 10, the amplified difference voltage increases. Consequently, the on resistance of the output transistor 12 increases and the output voltage (Vout) decreases. Therefore, in a case that the voltage Va is used as the feedback signal and inputted into the error amplifier 11, the constant voltage power circuit may be controlled to generate the constant output voltage (Vout).

In order to prevent the output current through the output transistor 12 from being too high, the voltage regulator usually includes the overcurrent protection circuit. As shown in FIG. 1A, the overcurrent protection circuit comprises a transistor 15, a resistor 16, a transistor 17, a resistor 18 and a transistor 19.

As shown in FIG. 1A, a gate of the output transistor 12 and a gate of the transistor 15 are connected with each other, so that there is a fixed ratio between a current flowing through the transistor 15 and the output current. The fixed ratio is based on the size of the output transistor 12 and the transistor 15. Obviously, when a load resistor 20 decreases, the output current increases. When the higher the output current, a current through the resistor 16 is higher and a gate voltage of the transistor 17 is higher.

When the output current reaches the overcurrent value, the gate voltage of the transistor 17 is higher than the threshold voltage. The transistor 17 is turned on and a current flows through the resistor 18. Therefore, the transistor 19 is turned on, the gate voltage of the output transistor 12 increases, and then the output transistor 12 is turned off. Since the output voltage (Vout) of the constant voltage power circuit decreases, the overcurrent protection mechanism is formed.

As shown in FIG. 1B, when the output current reaches the overcurrent value, the overcurrent protection circuit is enabled and the output voltage (Vout) decreases quickly. As shown in FIG. 1B, when the output voltage (Vout) decreases, the output current is still very high. Such overcurrent protection circuit is called a drooping type overcurrent protection circuit.

U.S. Pat. No. 7,233,462 discloses a voltage regulator with a fold-back overcurrent protection circuit. Please refer to FIG. 2A and FIG. 2B. FIG. 2A is the voltage regulator with a fold-back overcurrent protection circuit in the related art. FIG. 2B is a graphical representation explaining the output voltage and the output current of the voltage regulator with the fold-back overcurrent protection circuit.

In comparison with the overcurrent protection circuit in FIG. 1A, the overcurrent protection circuit in FIG. 2A further includes a transistor 2, a transistor 3 and a transistor 1. A gate of the transistor 2 is connected to a drain the transistor 2, and the gate of the transistor 2 is connected to a drain of the transistor 1. A gate of the transistor 1 is connected to the node A. A source of the transistor 1 is connected to the ground terminal. A gate of the transistor 3 is connected to the gate of the transistor 2. A drain of the transistor 3 is connected to a drain of the transistor 17 and a gate of the transistor 19. The transistor 2 and the transistor 3 are collectively defined as a current mirror circuit.

When the output voltage Vout of the constant voltage power circuit is normal, the voltage Va at the node A is higher than the threshold voltage of the transistor 1. Consequently, the transistor 1 is turned on, and a current will flow through the transistor 2. At the same time, the transistor 3 will generate the same current value.

When a short circuit occurs at the output terminal, the output voltage Vout decreases and the output current increases. Thus, a current flowing through the transistor 15 increases and the voltage Va decreases. A current flowing through the resistor 16 increases and the gate voltage of the transistor 17 increases. Obviously, if the gate voltage of the transistor 17 exceeds the threshold voltage, the transistor 17 is turned on. When a generated current upon the transistor 17 starting up exceeds a current flowing into the transistor 3, a gate voltage of the transistor 19 decreases and a gate voltage of the transistor 12 increases. Therefore, the overcurrent protection circuit limits the output current.

In other words, when the overcurrent protection circuit operates, the decreased output voltage causes the gate voltage (Va) of the transistor 1 to decrease, so that a current flowing into the transistor 2 is also suppressed. Because the transistor 3 and the transistor 2 form the current mirror circuit, the current flowing through the transistor 3 is also suppressed.

Please refer to a curve I in FIG. 2B, when the short circuit occurs and the output current exceeds an overcurrent value, the output current decreases while the output voltage decreases. Thus a fold-back overcurrent protection circuit is generated.

However, due to a semiconductor process deviation, the actual resistance values of the resistor 13, the resistor 14 and the resistor 16 are very different from the designed resistance values. Since the resistor 13 and the resistor 14 are collectively defined as a voltage divider circuit, even if they can not obtain accurate resistance values, the ratio of the resistor 13 and the resistor 14 is not changed by the semiconductor process deviation. Thus, the semiconductor process deviation does not make a great impact on the voltage divider circuit.

The resistance value of the resistor 16 makes a great impact on the entire overcurrent protection circuit. Since a voltage drop of the resistor 16 is used to control the protection circuit startup or not, when the actual resistance value of the resistor 16 is higher than the designed resistance value, the curve of the output voltage and the output current of the regular becomes a curve II. On the contrary, when the actual resistance value of the resistor 16 is lower than the designed resistance value, the curve of output voltage and the output current of the regular becomes a curve III.

In other words, the change of the resistance of the resistor 16 makes the startup time of the overcurrent protection circuit different. Thus, the curve of the output voltage and the output current of the regular may be varied between curve II and curve III. It causes the application of the voltage regulator problem.

U.S. Pat. No. 7,183,755 also revealed another type of voltage regulator with a fold-back overcurrent protection circuit. Please refer to FIG. 3, the voltage regulator with the fold-back overcurrent protection circuit 100 includes a constant voltage power circuit 101 and an overcurrent protection circuit 102.

The constant voltage power circuit 101 includes: a reference voltage 111, an output transistor M101, an error amplifier AMP, a resistor R101 and a resistor R102. The resistor R101 and the resistor R102 are connected in series between an output voltage terminal (OUT) and a ground voltage to form a voltage divider circuit. Therefore, a divided voltage VFB is proportional to an output voltage Vo. The divided voltage VFB is a feedback signal to be inputted into the error amplifier AMP. The error amplifier AMP amplifies a difference voltage between the reference voltage 111 and the divided voltage VFB. An output terminal of the error amplifier AMP generates an amplified difference voltage and controls the output transistor M101. Therefore, the output voltage Vo is a constant value.

The overcurrent protection circuit 102 includes PMOS FET (field-effect transistor) devices M102, M103, M106, M107, depletion-type NMOS FET devices M104, M105, a resistor R103, a bias current source 112 and an offset voltage Vof. If an output current (io) is less than an overcurrent value of the overcurrent protection circuit 102, a drain current of transistor M102 is relatively small and flows through the resistor R103. Therefore, a drain voltage of the transistor M105 can not turn on the transistor M105. Meanwhile, the drain voltage of the transistor M105 is almost equal to an input voltage (Vin). Consequently, the transistor M103 fails to be turned on, and the overcurrent protection circuit 102 does not start up.

If the output current (io) is higher than the overcurrent value of the overcurrent protection circuit 102, the overcurrent protection circuit 102 starts up. Meanwhile, a voltage drop of the resistor R103 is higher than the threshold voltage of the transistor M105 to turn on the transistor M105. The decreasing drain voltage of the transistor M105 causes the transistor M105 to be turned on, and then a gate voltage of the transistor M101 increases. An output current from transistor M101 decreases and the output voltage decreases. Therefore, the overcurrent protection mechanism is formed.

Similarly, the voltage drop of the resistor R103 controls the overcurrent protection circuit 102 to start up or not. However, the process deviation causes an error of the resistor R103, and thus the overcurrent value fails to be confirmed. Therefore, it makes the startup time of the overcurrent protection circuit different. It causes problems in the applications of the voltage regulator.

Please refer to FIG. 4, it revealed another type of voltage regulator with a fold-back overcurrent protection circuit. Wherein, the voltage regulator with the fold-back overcurrent protection circuit 200 includes a constant voltage power circuit 220 and an overcurrent protection circuit 230.

The constant voltage power circuit 220 includes: a reference voltage 11, an output transistor M1, an error amplifier A1, a resistor R1 and a resistor R2. The resistor R1 and the resistor R2 are connected in series between an output terminal (OUT) and a ground voltage to form a voltage divider circuit. Therefore, a divided voltage VFB is proportional to an output voltage Vo. The divided voltage VFB is a feedback signal to be inputted into an error amplifier A1. The error amplifier A1 amplifies a difference voltage between the reference voltage 211 and the divided voltage VFB. An output terminal of the error amplifier A1 generates an amplified difference voltage and controls the output transistor M1. Therefore, the output voltage Vo is a constant value.

The overcurrent protection circuit 230 includes PMOS FET (field-effect transistor) devices M2, M3, M6, NMOS FET devices M4, M7, M8, resistors R3, R4, bias current source 212 and an offset voltage Vof. Wherein, M5, M6, M7, M8, bias current source 212 and the offset voltage Vof forms a differential amplifier A2. If an output current (io) is less than an overcurrent value of the overcurrent protection circuit 230, a drain current of transistor M2 is relatively small and flows through resistor R3. Therefore, a drain voltage of the transistor M6 can turn on the transistor M6, and the transistor M5 is turned off. Meanwhile, the drain voltage of the transistor M5 is close to the ground voltage, so that the transistor M4 fails to be turned on and the drain voltage of the transistor M3 is equal to a input voltage (Vin). Meanwhile, the overcurrent protection circuit 230 does not start up.

If the output current (io) is higher than the overcurrent value of the overcurrent protection circuit 230, the overcurrent protection circuit 230 starts up. Meanwhile, a voltage drop of the resistor R3 causes the transistor M6 to be turned off and the transistor M105 to be turned on. Since the transistor M7 and the transistor M4 are collectively defined as a current mirror circuit and turned on at the same time, the transistor M3 is turned on and a gate voltage of the transistor M1 is close to a input voltage (Vin). Meanwhile, an output current from the transistor M1 decreases, and the output voltage decreases. Therefore, the overcurrent protection mechanism is formed.

Similarly, the voltage drop of the resistor R3 controls the overcurrent protection circuit 230 to start up or not. However, the process deviation causes an error of the resistor R3, so that the overcurrent value fails to be confirmed. Therefore, it makes the startup time of the overcurrent protection circuit 230 different. It causes problems in the applications of the voltage regulator.

Accordingly, it is an object of the invention to provide a regulator with a fold-back overcurrent protection circuit for improving the related issue about semiconductor process deviation which causes the overcurrent value uncertainty, and at the same time setting a minimum output current of the voltage regulator when a short circuit occurs.

SUMMARY OF THE INVENTION

It is an object of the invention to provide a voltage regulator with a fold-back overcurrent protection circuit, in which the overcurrent value is not adversely affected by semiconductor process deviation and it is more useful for the actual applications of the voltage regulator.

The invention discloses a voltage regulator. The voltage regulator includes a constant voltage power circuit and an overcurrent protection circuit. The constant voltage power circuit includes a voltage output terminal for generating a constant output voltage and an output current. The constant voltage power circuit further generates a divided voltage, which is proportional to the output voltage. The overcurrent protection circuit includes a current sensing unit, a first mirroring unit, a voltage to current converting unit, a second mirroring unit, and a pull up unit. The current sensing unit is used for generating a sensing current according to the output current. The first mirroring unit has a first current input terminal receiving the sensing current and a first mirroring current output terminal generating a first mirroring current according to the sensing current, wherein the first mirroring current is proportional to the output current. The voltage to current converting unit is used for generating a first current according to the divided voltage. The second mirroring unit has a second current input terminal receiving a second current and a second mirroring current output terminal generating a second mirroring current, wherein the second mirroring current is proportional to the second current and the first current is included in the second current. The pull up unit is connected to the first mirroring current output terminal and the second mirroring current output terminal for controlling the output voltage and the output current according to the first mirroring current and the second mirroring current.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF PREFERRED EMBODIMENTS

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1A:
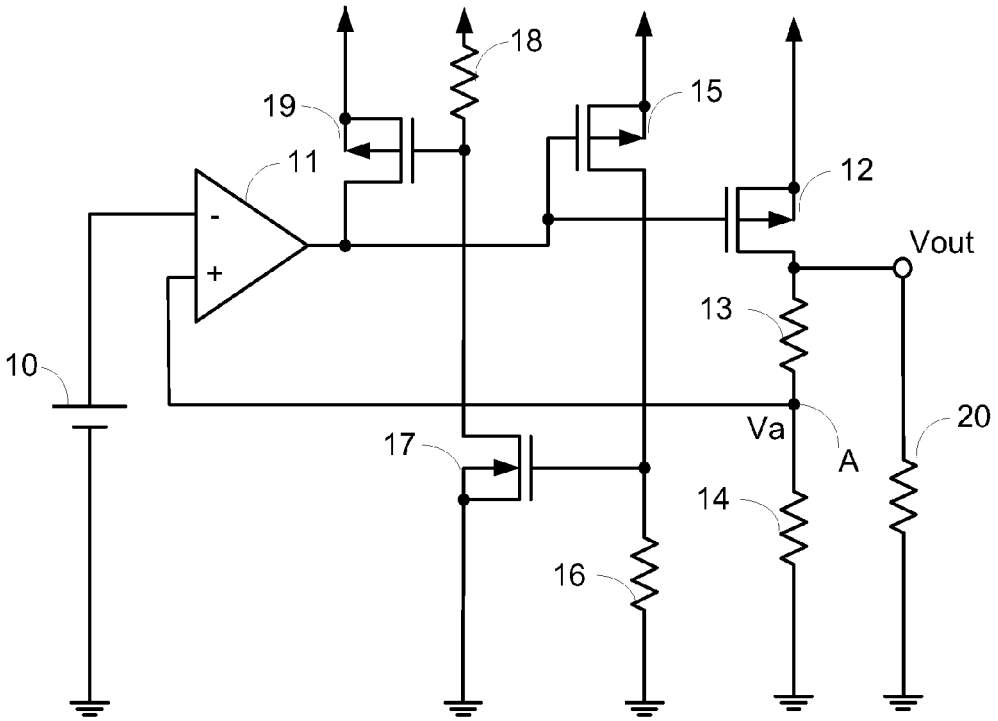
FIG. 1A (PRIOR ART)
FIG. 1A (Prior art) is a voltage regulator with a drooping type overcurrent protection circuit in the related art.
Figure 1B:
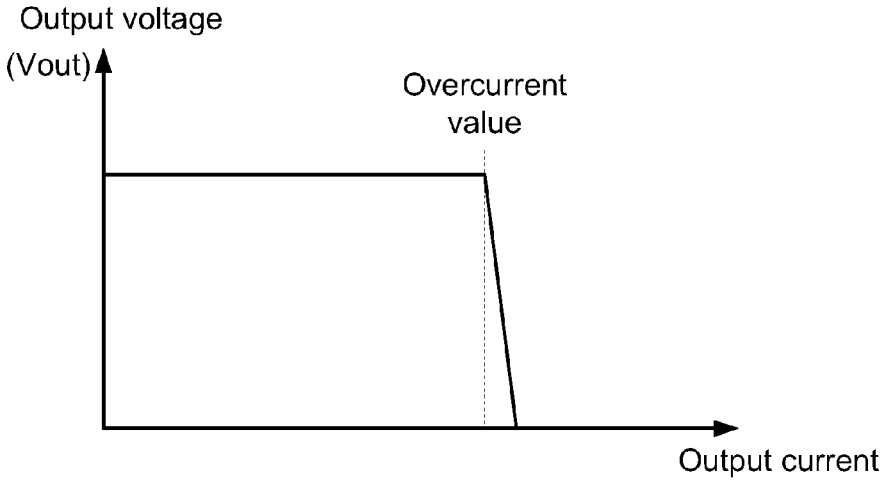
FIG. 1B (PRIOR ART)
FIG. 1B (Prior art) is a graphical representation explaining the output voltage and the output current of the voltage regulator with the drooping type overcurrent protection circuit.
Figure 2A:
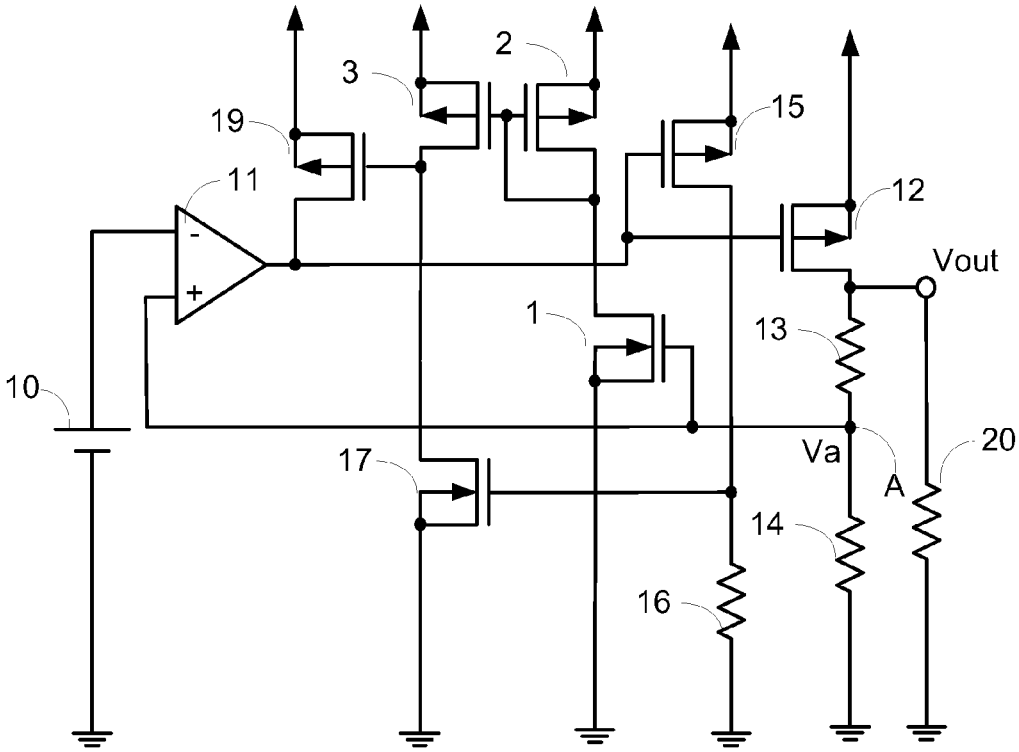
FIG. 2A (PRIOR ART)
FIG. 2A (Prior art) is a voltage regulator with a fold-back overcurrent protection circuit in the related art.
Figure 2B:
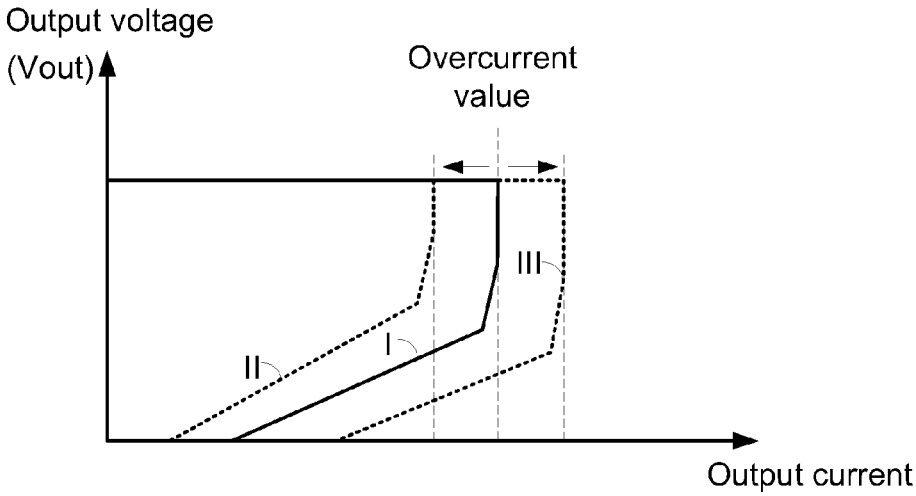
FIG. 2B (PRIOR ART)
FIG. 2B (Prior art) is a graphical representation explaining the output voltage and the output current of the voltage regulator with the fold-back overcurrent protection circuit.
Figure 3:
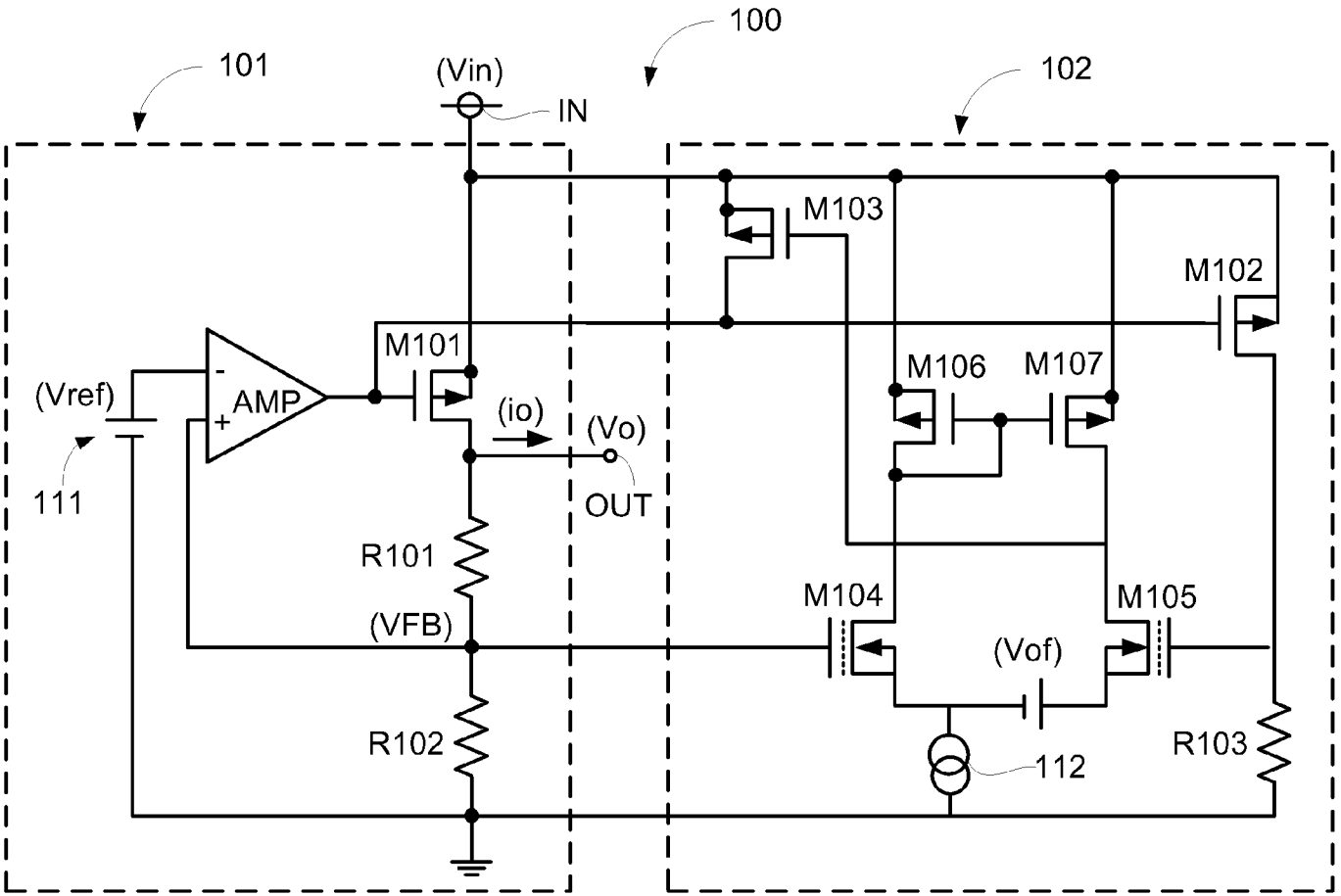
FIG. 3 (PRIOR ART)
FIG. 3 (Prior art) is another voltage regulator with a fold-back overcurrent protection circuit in the related art.
Figure 4:
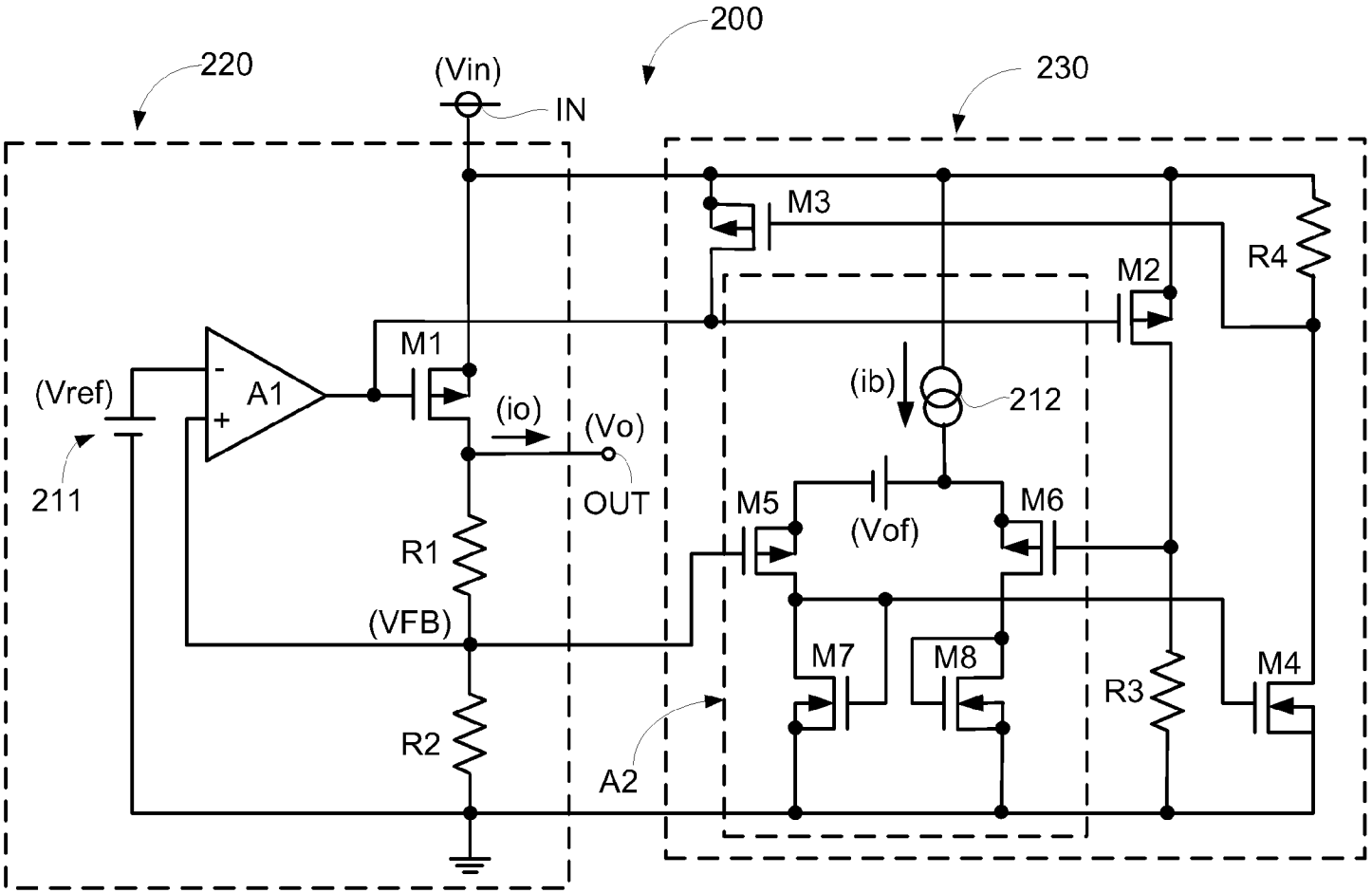
FIG. 4 (PRIOR ART)
FIG. 4 (Prior art) is another voltage regulator with a fold-back overcurrent protection circuit in the related art.
Figure 5A:
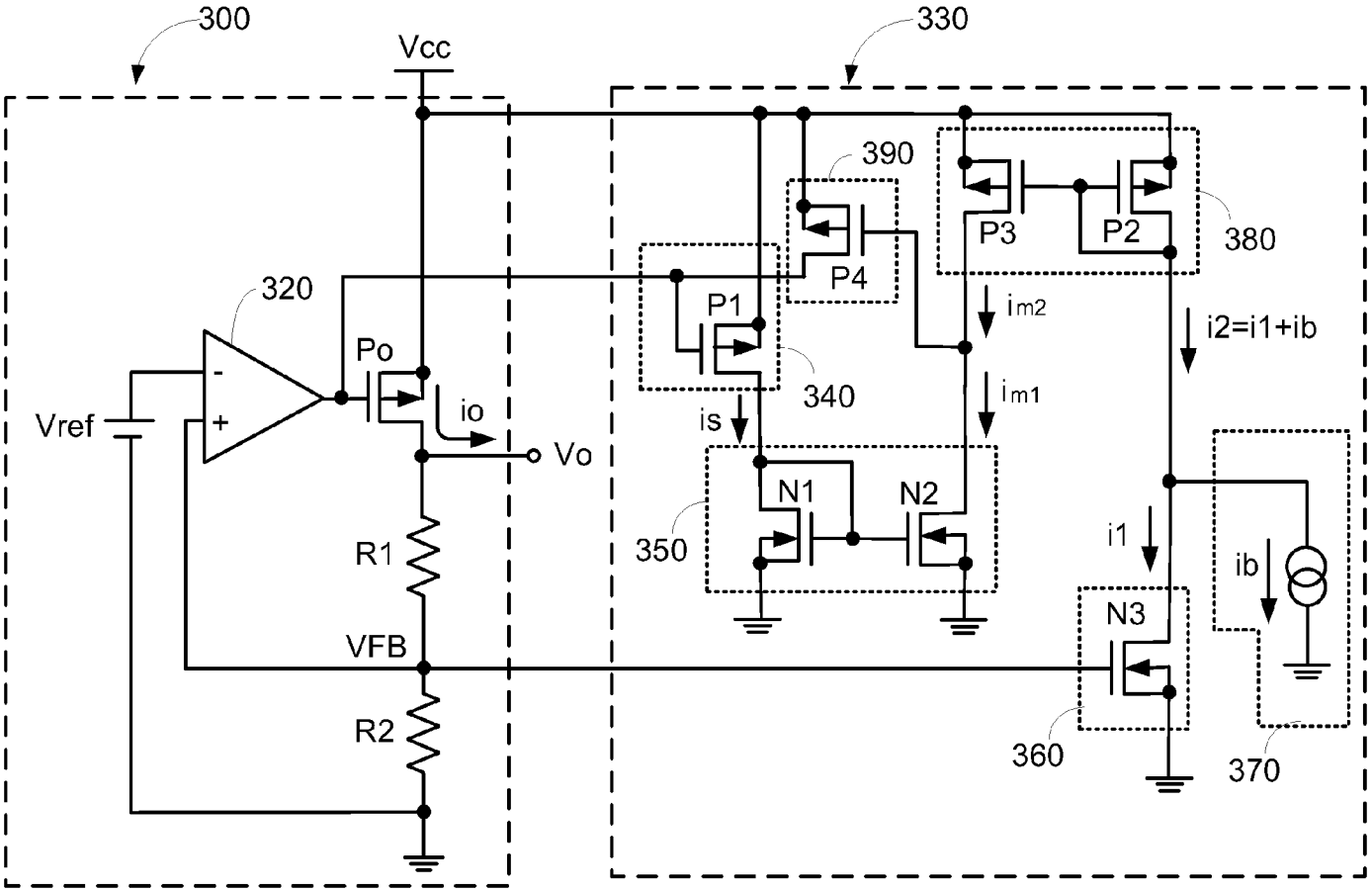
FIG. 5A is a voltage regulator with a fold-back overcurrent protection circuit according to the first embodiment of the invention.

Please refer to FIG. 5A, which illustrates a voltage regulator with a fold-back overcurrent protection circuit according to an embodiment of the invention. The voltage regulator with the fold-back overcurrent protection circuit includes a constant voltage power circuit 300 and an overcurrent protection circuit 330.

The constant voltage power circuit 300 includes a reference voltage source Vref, an output transistor Po, an error amplifier 320, a first resistor R1 and a second resistor R2. The resistor R1 and the resistor R2 are connected in series between a voltage output terminal (Vo) and a ground voltage to form a voltage divider circuit. A divided voltage VFB is proportional to the output voltage Vo. The divided voltage VFB is a feedback signal to be inputted into a positive terminal of the error amplifier 320. A negative terminal of the error amplifier 320 receives the reference voltage Vref. The error amplifier 320 generates an amplified difference voltage by amplifying a difference voltage between the reference voltage Vref and the divided voltage VFB. A gate voltage of the output transistor Po is connected to an output terminal of the error amplifier 320, a source voltage of the output transistor Po is connected to a power voltage Vcc, and a drain voltage of the output transistor Po is connected to the voltage output terminal (Vo). Therefore, the output terminal of the error amplifier 320 controls the output transistor Po and the output voltage Vo to be maintained at a constant value. The detailed operation method will be illustrated as follows.

In normal operation, the divided voltage VFB is close to the reference voltage Vref. When the divided voltage VFB is lower than the reference voltage Vref, the amplified difference voltage decreases. Therefore, a gate-source voltage of the output transistor Po increases, the on resistance decreases, and the output voltage Vo increases. Conversely, when the divided voltage VFB is higher than the reference voltage Vref, the amplified difference voltage increases, the on resistance of the output transistor Po increases, and the output voltage Vo decreases. The divided voltage VFB is used as a feedback signal and inputted into the error amplifier 320, so that the output voltage Vo of the constant voltage power circuit 300 is controlled to be a constant value.

In addition, the overcurrent protection circuit 330 includes a current sensing unit 340, a first mirroring unit 350, a second mirroring unit 380, a constant current providing unit 370, a voltage to current converting unit 360 and a pull up unit 390. The detailed operation method will be illustrated as follows.

The current sensing unit 340 generates a sensing current (is) according to an output current io. The sensing current (is) is proportional to the output current io. In addition, the current sensing unit 340 includes a transistor P1. A gate of the transistor P1 is connected to the output terminal of the error amplifier 320, a source of the transistor P1 is connected to the power voltage Vcc, and a drain of the transistor P1 generates the sensing current (is). Since the output transistor Po is connected to the gate of the transistor P1, there is a fixed ratio between the sensing current (is) and the output current io. The ratio is determined according to a size of the transistor P1 and a size of the output transistor Po. For example, is=p1×io, wherein p1 is a first ratio.

The first mirroring unit 350 has a first current input terminal connected to the current sensing unit 340 for receiving the sensing current (is), and has a first mirroring current output terminal generating a first mirroring current im1. In addition, the first mirroring unit 350 has a transistor N1 and a transistor N2. A drain of the transistor N1 is the first current input terminal and connected to a gate of the transistor N1, and a source of the transistor N1 is connected to the ground terminal. A drain of the transistor N2 is the first mirroring current output terminal, a gate of the transistor N2 is connected to the gate of the transistor N1, and a source of the transistor N2 is connected to the ground terminal. Wherein, there is a fixed ratio between the sensing current (is) and the first mirroring current im1. The ratio is determined according to a size of the transistor N1 and a size the transistor N2. For example, im1=p2×is, wherein p2 is a second ratio. Therefore, the relationship between the output current io and the first mirror current im1 is: im1=p2×p1×io.

The voltage to current converting unit 360 is used for receiving the divided voltage VFB and converting the divided voltage VFB into a first current i1. The voltage to current converting unit 360 includes a transistor N3, wherein a gate of the transistor N3 receives the divided voltage VFB, a drain of the transistor N3 generates the first current, and a source of the transistor N3 is connected to the ground terminal.

The constant current providing unit 370 includes a constant current source for supplying a constant current ib. The constant current providing unit 370 provides the constant current ib while the voltage regulator starts up and prevents an excessive output current io. The constant current providing unit 370 sets a start-up current limit. Furthermore, the constant current ib is the minimum current limit of the output current io while a short circuit occurs in the voltage regulator.

The second mirroring unit 380 has a second current input terminal connected to the voltage to the current converting unit 360 and the constant current providing unit 370 for receiving a second current i2, and has a second mirror current output terminal generating a second mirror current im2. The second current i2 is equal to the first current i1 plus the constant current ib. Furthermore, the second mirroring unit 380 includes a transistor P2 and a transistor P3. A drain of the transistor P2 is the second current input terminal and connected to a gate of the transistor P2, and a source of the transistor P2 is connected to the power voltage Vcc. A drain of the transistor P3 is the second mirror current output terminal, a gate of the transistor P3 is connected to the gate of the transistor P2, and a source of the transistor P3 is connected to the power voltage Vcc. Wherein, there is a fixed ratio between the second current i2 and the second mirror current im2. The ratio is determined according to a size of the transistor P2 and a size of the transistor P3. For example, im2=p3×i2, wherein p3 is a third ratio. Therefore, the relationship between the second current i2 and the second mirror current im2 is: im2=p3×i2.

The pull up unit 390 is connected to the first mirroring current output terminal and the second mirroring current output terminal. Moreover, the pull up unit 390 determines whether the pull up unit 390 starts up according to the first mirroring current im1 and the second mirror current im2. The pull up unit 390 includes a transistor P4, wherein a gate of the transistor P4 is connected to the first mirroring current output terminal and the second mirroring current output terminal, a source of the transistor P4 is connected to the power voltage Vcc, and a drain of the transistor P4 is connected to the output terminal of the error amplifier 320. For example, if the first mirroring current im1 is lower than the second mirror current im2, the pull up unit 390 is disabled. Conversely, if the first mirroring current im1 is higher than the second mirror current im2, the pull up unit 390 is enabled to pull the output terminal of the error amplifier 320 up to the power voltage Vcc.

According to the first embodiment of the invention, when the voltage regulator is in normal operation, the constant current providing unit 370 supplies a constant current ib, and the divided voltage VFB controls the current converting unit 360 to generate the first current i1. Therefore, the second current i2 is the sum of the first current i1 and the constant current ib. And, the second mirroring unit 380 generates the second mirror current im2. The second mirror current im2 is the threshold current signal for determining whether the overcurrent protection circuit 330 starts up or not.

Furthermore, the current sensing unit 340 and the first mirroring unit 350 show the first mirroring current im1 is proportional to the output current io. According to a proper design, when the output current io is smaller than the overcurrent value, the first mirroring current im1 is less than the second mirror current im2, so that the pull up unit 390 is disabled. On the other hand, when the output current io reaches the overcurrent value, the first mirroring current im1 is higher than the second mirror current im2, so that the pull up unit 390 is enabled. Meanwhile, the output terminal of the error amplifier 320 is pulled up to the power voltage Vcc, and the output transistor Po is turned off.

As shown in FIG. 5A, when the short circuit occurs at the voltage output terminal (Vo) of the constant voltage power circuit 300, the output current io increases. Therefore, the first mirroring current im1 is higher than the second mirror current im2, so that the transistor P4 is turned on. Under this circumstance, the gate voltage of the output transistor Po increases, and the output current io decreases, so that the limiting function of the fold-back overcurrent protection circuit is achieved. Furthermore, when the short circuit occurs at the voltage output terminal (Vo) of the constant voltage power circuit 300, the divided voltage VFB fails to turn on the transistor N3, so the first current i1 is zero. That is, the minimum current limit of the output current is the constant current ib while a short circuit occurs in the constant voltage power circuit 300.

Figures 5B, 5C:
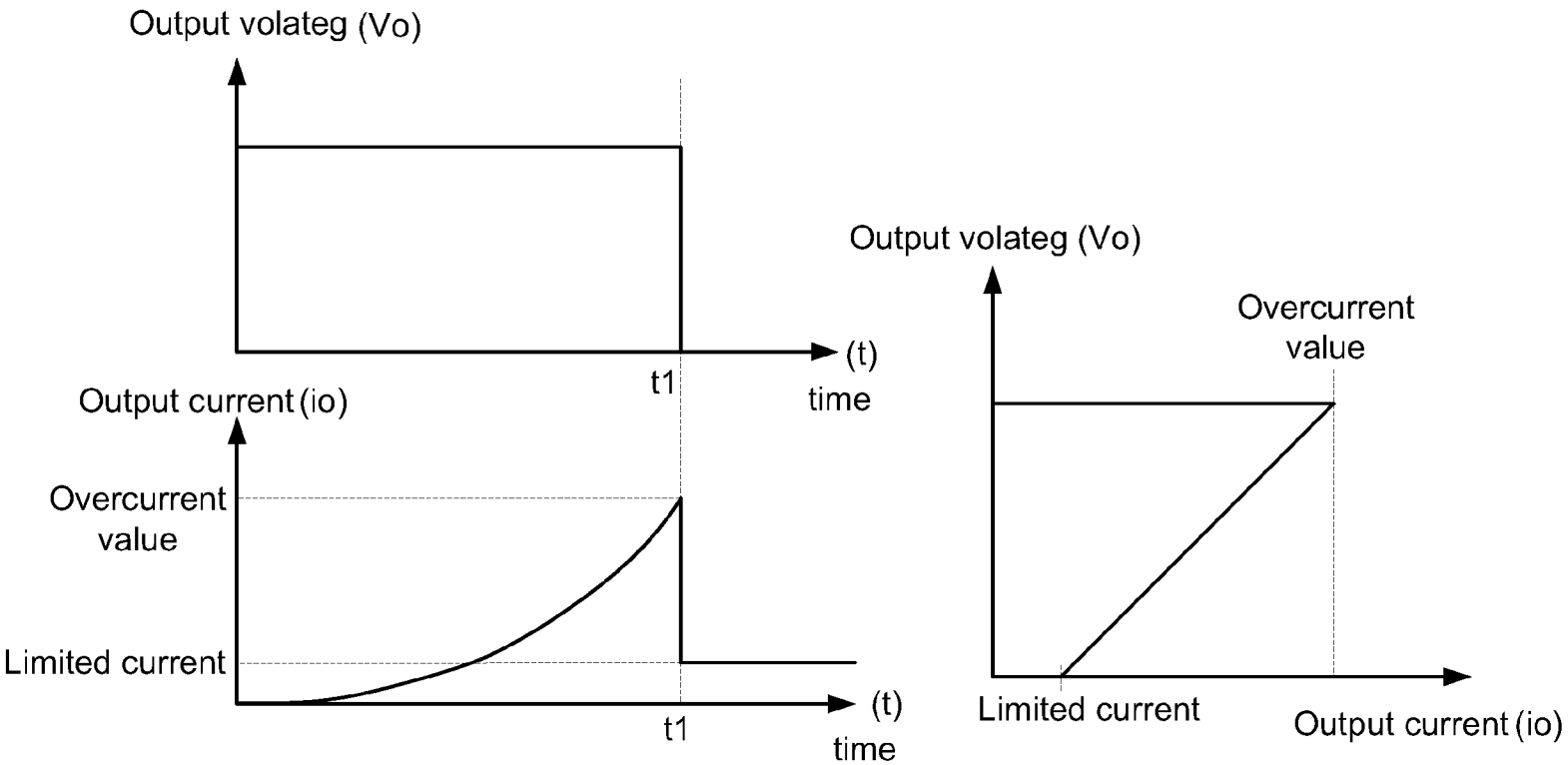
FIG. 5B and FIG. 5C are graphical representations explaining the output voltage and the output current of the voltage regulator with the fold-back overcurrent protection circuit according to the first embodiment of the invention.

FIG. 5B and FIG. 5C show the output voltage and the output current of the first embodiment of the invention. As shown in FIG. 5B, before the time t1, the output current io increases and the output voltage Vo maintains a fixed value. At the time t1, the output current io reaches the overcurrent value(or a short-circuit problem occurs), the output voltage Vo decreases rapidly to zero and the output current io decreases to the minimum current limit. From the relationship between the output voltage and the output current in FIG. 5C, it is found that the overcurrent protection circuit of the first embodiment of the invention is the fold-back overcurrent protection circuit.

Figure 6A:
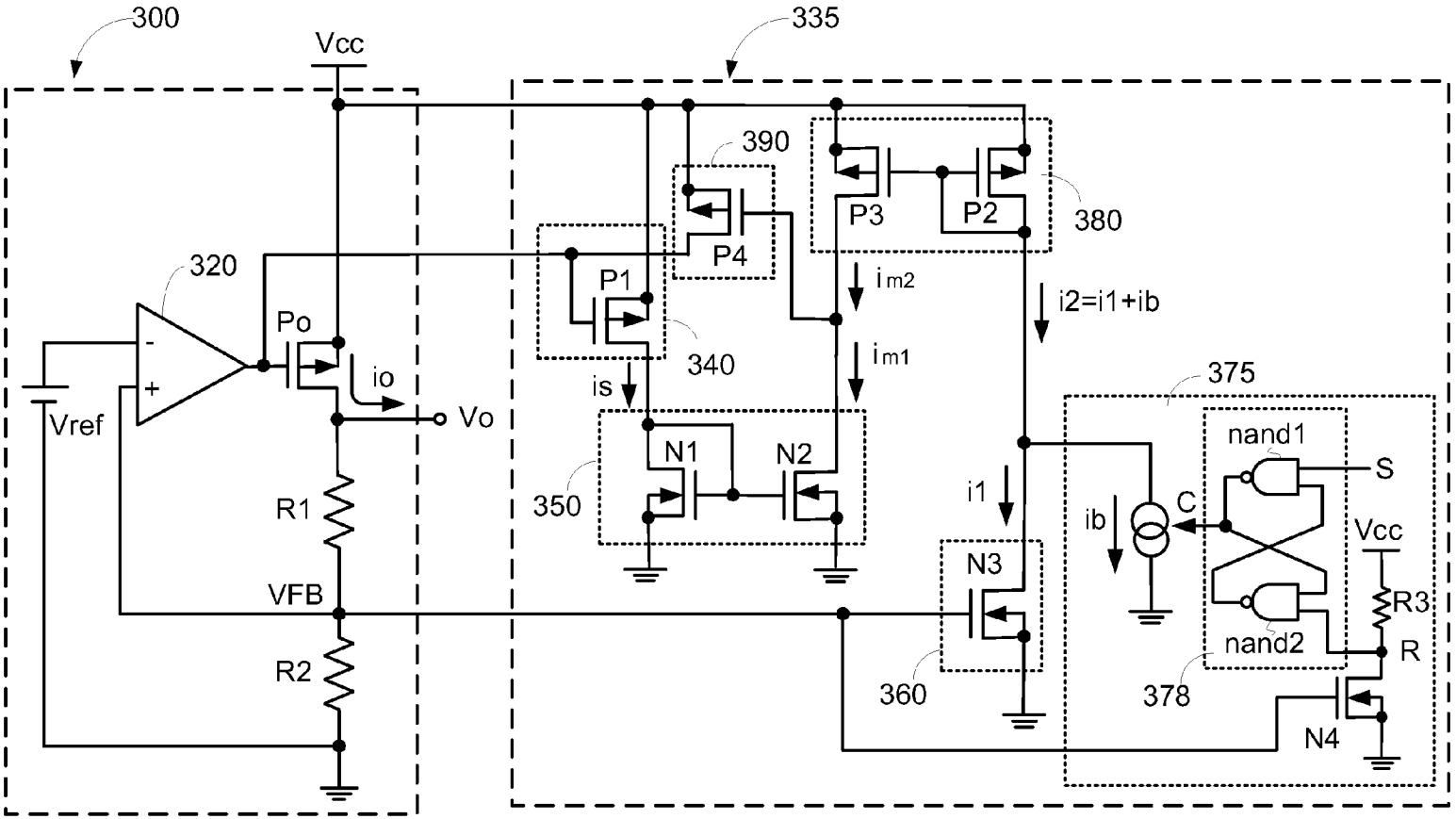
FIG. 6A is a voltage regulator with a fold-back overcurrent protection circuit according to the second embodiment of the invention.

Please refer to FIG. 6A, a voltage regulator with a fold-back overcurrent protection circuit according to the second embodiment of the invention. Wherein, the voltage regulator with the fold-back overcurrent protection circuit of the invention includes a constant voltage power circuit 300 and an overcurrent protection circuit 335.

The difference of the second embodiment and the first embodiment is a constant current providing unit 375. The constant current providing unit 375 of the second embodiment sets a start-up current limit when the voltage regulator starts up. And, when the short circuit occurs at the constant voltage power circuit 300, the output current io decreases to zero. In other words, the minimum current limit of the voltage regulator is zero.

The constant current providing unit 375 includes a constant current source, a latch 378, a switch transistor N4, and a third resistor R3. The latch 378 has a set terminal S, a reset terminal R and an output terminal C. The constant current source controls the constant current source in response to a signal of the output terminal C of the latch 378. A gate of the switch transistor N4 receives the divided voltage VFB, a drain of the switch transistor N4 is connected to the reset terminal R of the latch 378, and a source of the switch transistor N4 is connected to the ground terminal. The third resistor R3 is connected between the power voltage Vcc and the reset terminal R of the latch 378. The latch 378 is formed by two NAND gates nand1 and nand2. Wherein, a first input terminal of the first NAND gate nand1 is the set terminal S, and an output terminal is the output terminal C of the latch 378. A first input terminal of the second NAND gate nand2 is the reset terminal R, and an output terminal is connected to a second input terminal of the first NAND gate nand1.

Wherein, while the voltage regulator starts up, the set terminal S of the latch 378 has a low logic level increased to a high logic level gradually. Meanwhile, since the set terminal S is at a low logic level and the reset terminal R is at a high logic level (the switch transistor is turned off), the output terminal C is at the high logic level, and the constant current providing unit 375 generates the constant current ib. The constant current ib is the start-up current limit.

While the voltage regulator is in normal operation, the set terminal S of the latch 378 reaches the high logic level, and the reset terminal R is low logic level (the divided voltage VFB controls the switch transistor turned on). Therefore, the output terminal C is at the low logic level, and the constant current providing unit 375 does not generate the constant current ib. It means that the constant current ib is zero. Therefore, when the short circuit occurs at the voltage output terminal (Vo) of the constant voltage power circuit 300, the output current io can be decreased to zero.

Figure 6C:
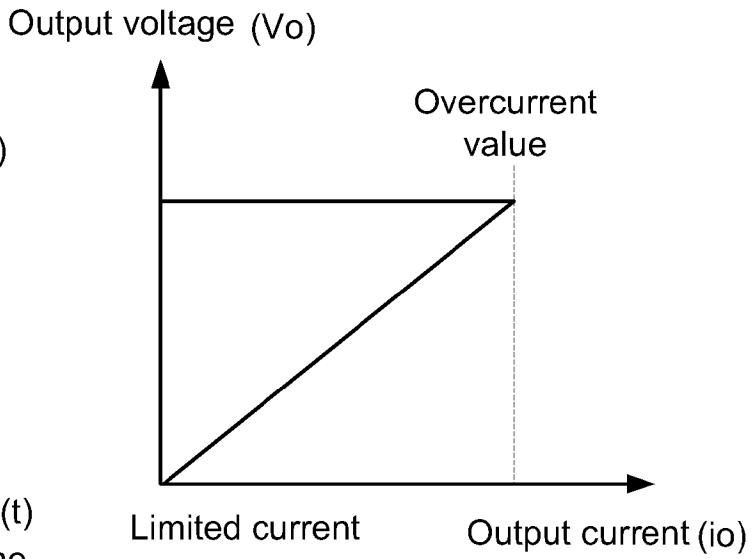
FIG. 6B and FIG. 6C are graphical representations explaining the output voltage and the output current of the voltage regulator with the fold-back overcurrent protection circuit according to the second embodiment of the invention.
Figure 6B:
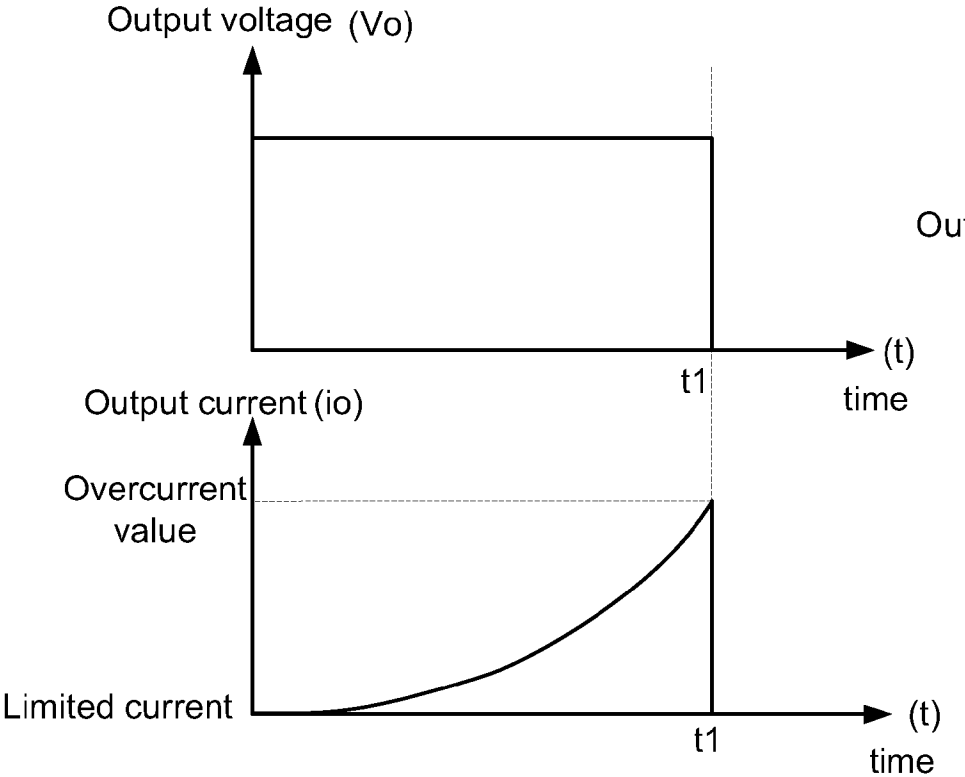

FIG. 6B and FIG. 6C show the output voltage and the output current of the voltage regulator with the fold-back overcurrent protection circuit according to the second embodiment of the invention. As shown in FIG. 6B, before the time t1, the output current io increases and the output voltage Vo maintains a fixed value. At the time t1, the output current io reaches the overcurrent value (or a short-circuit problem occurs), the output voltage Vo decreases rapidly to zero, and the output current io decreases to zero. From the output voltage and the output current relationship in FIG. 6C, it is found that the overcurrent protection circuit of the second embodiment of the invention is the fold-back overcurrent protection circuit.

Of course, if the voltage regulator with the start-up current limit is not taken into consideration, the overcurrent protection circuit 330 does not need the constant current providing unit 370 as shown in FIG. 5A and the constant current providing unit 375 as shown in FIG. 6A.

Figure 7:
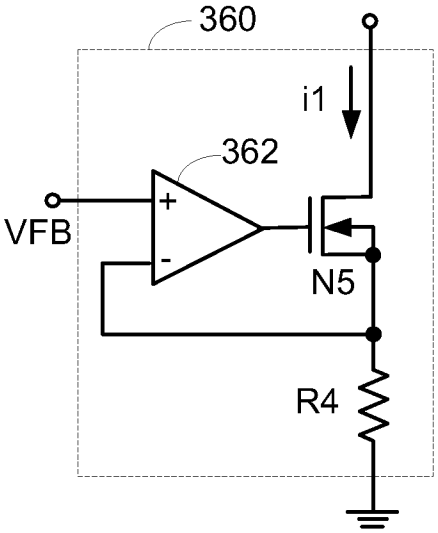
FIG. 7 is another exemplary voltage to current converting unit used in the overcurrent protection circuit.

Furthermore, the voltage to current converting unit 360, the first mirroring unit 350 and the second mirroring unit 380 in the invention can be implemented by other circuits. The voltage to current converting unit 360 as shown in FIG. 7 includes a differential amplifier 362, a transistor N5, and a second resistor R2. Wherein, a positive terminal of the differential amplifier 362 receives the divided voltage VFB. A drain of the transistor N5 receives the first current i1, a gate of the transistor N5 is connected to an output terminal of the differential amplifier 362, and a source of the transistor N5 is connected to a negative terminal of the differential amplifier 362. The second resistor R2 is connected between the source of the transistor N5 and the ground terminal. Therefore, the following relationship is obtained: i1=VFB/R2.

Figure 8:
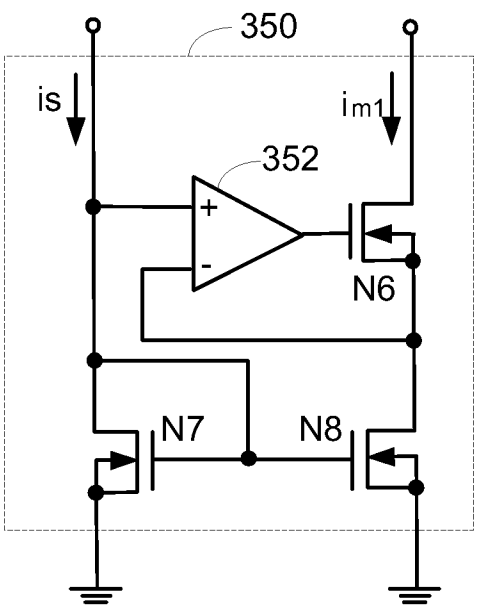
FIG. 8 is another exemplary first mirroring unit used in the overcurrent protection circuit.

As shown in FIG. 8, the first mirroring unit 350 includes a differential amplifier 352, a transistor N6, a transistor N7 and a transistor N8. Wherein, a drain of the transistor N7 receives the sensing current (is), and a source of the transistor N7 is connected to the ground terminal. A positive terminal of the differential amplifier 352 is connected to the drain of the transistor N7. A drain of the transistor N6 receives the first mirroring current im1, a gate of the transistor N6 is connected to an output terminal of the differential amplifier 352, and a source of the transistor N6 is connected to the negative input terminal of the differential amplifier 352. A gate of the transistor N8 is connected to a gate of the transistor N7, a drain of the transistor N8 is connected to a source of the transistor N6, and a source of the transistor N8 is connected to the ground terminal. Therefore, there is a fixed ratio between the sensing current (is) and the first mirroring current im1. Similarly, the second mirroring unit 380 can be implemented in a similar manner, an is not redundantly described herein.

Obviously, the present invention provides the voltage regulator with a fold-back overcurrent protection circuit, in which the adverse influence induced by semiconductor process deviation is largely reduced and the error of the overcurrent value is minimized. Moreover, it is more useful to the practical applications of the voltage regulator.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A voltage regulator comprising:

a constant voltage power circuit comprising a voltage output terminal for generating a constant output voltage and an output current, wherein the constant voltage power circuit further generates a divided voltage, which is proportional to the output voltage; and an overcurrent protection circuit comprising:

a current sensing unit for generating a sensing current according to the output current;

a first mirroring unit having a first current input terminal receiving the sensing current and a first mirroring current output terminal generating a first mirroring current according to the sensing current, wherein the first mirroring current is proportional to the output current;

a voltage to current converting unit for generating a first current according to the divided voltage;

a second mirroring unit having a second current input terminal receiving a second current and a second mirroring current output terminal generating a second mirroring current, wherein the second mirroring current is proportional to the second current and the first current is included in the second current; and a pull up unit connected to the first mirroring current output terminal and the second mirroring current output terminal for controlling the output voltage and the output current according to the first mirroring current and the second mirroring current.

2. The voltage regulator according to claim 1, wherein the constant voltage power circuit comprises:

a reference voltage source for generating a reference voltage;

a voltage divider circuit connected to the voltage output terminal and a ground terminal for generating the divided voltage;

an error amplifier having a negative input terminal receiving the reference voltage and a positive input terminal receiving the divided voltage; and an output transistor having a gate connected to an output terminal of the error amplifier, a source connected to a voltage source and a drain connected the voltage output terminal.

3. The voltage regulator according to claim 2, wherein the current sensing unit comprising: a first P type transistor having a gate connected to the gate of the output transistor, a source connected to the voltage source, and a drain connected to the first current input terminal, wherein the sensing current is proportional to the output current.

4. The voltage regulator according to claim 2, wherein the first mirroring unit comprises:

a first N type transistor having a drain as the first current input terminal for receiving the sensing current, a gate connected to drain of the first N type transistor, and a source connected to the ground terminal; and a second N type transistor having a drain as the first mirroring current output terminal for generating the first mirroring current, a gate connected to the gate of the first N type transistor, and a source connected to the ground terminal, wherein the first mirroring current is proportional to the output current.

5. The voltage regulator according to claim 2, wherein the voltage to current converting unit comprises a third N type transistor, which has a gate receiving the divided voltage, a source connected to the ground terminal, and a drain connected to the second current input terminal and generating the first current.

6. The voltage regulator according to claim 2, wherein the second mirroring unit comprises:

a second P type transistor having a drain as the second current input terminal for receiving the second current, a gate connected to the drain of the second P type transistor, and a source connected to the voltage source; and a third P type transistor having a drain as the second mirroring current output terminal for generating the second mirroring current, a gate connected to the gate of the second P type transistor, and a source connected to the voltage source, wherein the second mirroring current is proportional to the second current.

7. The voltage regulator according to claim 2, wherein the pull up unit comprises a fourth P type transistor, which has a gate connected to the first mirroring current output terminal and the second mirroring current output terminal, a source connected to the voltage source, and a drain connected to the gate of the output transistor.

8. The voltage regulator according to claim 2, wherein the voltage to current converting unit comprises:

a first differential amplifier having a positive input terminal receiving the divided voltage;

a fifth N type transistor having a gate connected to an output terminal of the first differential amplifier, a drain generating the first current, and a source connected to a negative input terminal of the differential amplifier; and a resistor connected to the source of the fifth N type transistor and the ground terminal.

9. The voltage regulator according to claim 2, wherein the first mirroring unit comprises:

a sixth N type transistor having a drain as the first mirroring current output terminal for generating the first mirroring current;

a seventh N type transistor having a drain as the first current input terminal for receiving the sensing current, a gate connected to the drain of the seventh N type transistor, and a source connected to the ground terminal;

a second differential amplifier having a positive input terminal connected to the drain of the seventh N type transistor, a negative input terminal connected to the source of the sixth N type transistor, and a output terminal connected to a gate of the sixth N type transistor; and an eighth N type transistor having a drain connected to the source of sixth N type transistor, a source connected to the ground terminal, and a gate connected to a gate of the seventh N type transistor.

10. The voltage regulator according to claim 1, wherein the voltage regulator further comprises a constant current providing unit for generating a constant current, wherein the constant current providing unit is connected to the second current input terminal, so that the second current is equal to the sum of the first current and the constant current.

11. The voltage regulator according to claim 10, wherein the constant current providing unit is a constant current source for providing the constant current.

12. The voltage regulator according to claim 10, wherein the constant current providing unit comprising:

a latch having a set terminal, a reset terminal and an output terminal;

a constant current source connected to the output terminal of the latch for generating the constant current according to a logical level of the output terminal of the latch;

a switch transistor having a gate receiving the divided voltage, and a source connected to the ground terminal; and a resistor connected between a drain of the switch transistor and the voltage source.

13. The voltage regulator according to claim 1, wherein if the first mirroring current is higher than the second mirroring current, the output current is higher than an overcurrent value and the pull up unit controls the output transistor to lower the output voltage and the output current.

* * * * *